US006580933B2

(12) United States Patent
Abbas et al.

(10) Patent No.: US 6,580,933 B2
(45) Date of Patent: Jun. 17, 2003

(54) FREQUENCY STABLE RESONATOR WITH TEMPERATURE COMPENSATING LAYERS

(75) Inventors: Farhat Abbas, Twickenham (GB); Ran-Hong Yan, Farington (GB)

(73) Assignee: Lucent Technologies Inc., Murray Hill, DE (US)

( * ) Notice: Subject to any disclaimer, the term of this patent is extended or adjusted under 35 U.S.C. 154(b) by 0 days.

(21) Appl. No.: 09/825,030

(22) Filed: Apr. 3, 2001

(65) Prior Publication Data

US 2002/0014928 A1 Feb. 7, 2002

(30) Foreign Application Priority Data

Apr. 7, 2000 (EP) ..... 00302984

(51) Int. Cl.[7] ..... H01P 7/08; H01B 12/02

(52) U.S. Cl. ..... 505/210; 333/219.1; 333/234; 333/99.005; 505/700; 505/866

(58) Field of Search ..... 333/219.1, 234, 333/995; 505/210, 700, 866

(56) References Cited

U.S. PATENT DOCUMENTS

| | | | | |
|---|---|---|---|---|
| 4,580,116 A | | 4/1986 | Ballato | 333/234 |
| 4,661,790 A | | 4/1987 | Gannon et al. | 333/234 |
| 6,011,983 A | * | 1/2000 | Ishikawa et al. | 505/700 X |
| 6,281,769 B1 | * | 8/2001 | Fiedziuszko | 333/239 |

FOREIGN PATENT DOCUMENTS

| | | | |
|---|---|---|---|
| WO | WO 95/34096 | 12/1995 | H01L/39/24 |

OTHER PUBLICATIONS

Ultra–High–Q Resonators For Low–Noise, Microwave Signal Generation Using Sapphire Buffer Layers And Superconducting Thin Films, F. Abbas et al. Superconductor Science And Technology, 7(1994)Jul., No. 1, pp. 495–501. European Search Report dated Nov. 9, 2000.

* cited by examiner

*Primary Examiner*—Benny T. Lee

(57) ABSTRACT

A resonator for rf frequencies, especially microwave, in telecommunications systems, with an extremely stable resonant frequency over a desired operating temperature range, of predetermined width (Y) and thickness (X) and having a predetermined length (Z) in the direction of propagation for achieving a desired resonance, comprises a dielectric substrate of rutile, and first and second temperature compensating layers of sapphire on two opposite faces of the substrate and extending along the length of the substrate, these sapphire layers having a predetermined thickness, and first and second superconducting layers formed on the outer surfaces of the temperature compensating layers. The dielectric constant of rutile has an opposite temperature dependence to that of sapphire, and the thicknesses of the temperature compensating layers are selected such that the frequency of resonance of the resonator is maintained within a predetermined range over a predetermined temperature range, for example 1 part in $10^{15}$ over a temperature range of 1 $mK^0$.

12 Claims, 3 Drawing Sheets

SECOND AND FIRST DERIVATIVES OF PROPAGATION PHASE VELOCITY WITH RESPECT TO T, AT T=60 AS A FUNCTION OF THICKNESSES OF SUBSTRATE $d_1$ FOR A VARIETY OF $d_1$ LAYER THICKNESSES, 40mm TO 200mm DIFFERENT THICKNESSES $d_1$ LAYERS (40, 80, 120, 160 AND 200) mm

FREQUENCY STABLE RESONATOR WITH TEMPERATURE COMPENSATING LAYERS

CROSS-REFERENCE TO RELATED APPLICATION

This application claims priority of European Patent Application No. 00302984.0, which was filed on Apr. 7, 2000.

Related subject matter is disclosed in the following application assigned to the same assignee hereof: U.S. Patent application entitled "RF Resonator," Ser. No. 09/825,119, filed Apr. 3, 2001, now abandoned.

BACKGROUND OF THE INVENTION

1. Field of the Invention

The present invention relates to a resonator for use at radio frequency (rf), especially microwave frequencies, for use in telecommunications systems.

2. Description of the Related Art

Resonators are commonly used at microwave frequencies in filters, etc. since circuits formed of separate inductors and capacitors cannot easily be fabricated for use at microwave frequencies. Microwave resonators may take a variety of forms, but a common type is a short section of transmission line, a quarter wavelength or half a wavelength long and appropriately terminated. The transmission line may, for example comprise coaxial cable, microstrip, in which a strip conductor is separated from a metal groundplane by a layer of dielectric, or strip line in which a central strip conductor is separated from two opposing groundplane conductors by two layers of dielectric on either side of the strip conductor.

The properties of transmission lines employing superconductive films as conductive plates have been studied. Superconducting films commonly employ high temperature superconductors (HTS) such as YBCO. Commonly, these have a critical temperature in a range which terminates above $100^0$ K. In practice such films operate with cryogenic systems employing liquid nitrogen and operating at a temperature of $77^0$ K, the boiling point of liquid nitrogen. The properties of superconducting films in transmission lines, and the temperature dependence of the constituents of such transmission lines, are discussed in the following references:

[1] F Abbas, and L E Davis, "Propagation coefficient in a superconducting asymmetric parallel-plate transmission line with buffer layer", *J. Appi. Phys.* 73, pp. 4494–4499, 1993.

[2] X D Wu, A barn, M S Hegde, B Witkens, C C Chang, D M Hwang, L Nazar, T Venkatersan, S Miura, S Matsubara, Y Miyasaka, *Appl. Phys. Lett.* 54, 754 (1989).

[3] S Y Lee and H H Park, *J. Superconductivity,* 9, 545 (1996).

[4] N F Mott, *Advances Phys.* 39, 55 (1990).

[5] C Gallop, C D Langham, L Hao and Farhat Abbas, *IEEE Trans. Instrument, and Measurement.* 46, (1997).

SUMMARY OF THE INVENTION

The invention is based on the recognition that a resonator employing superconducting films may be constructed with an extremely stable resonant frequency value for changes in temperature. Further if, as is possible with cryogenic systems, the temperature is controlled very accurately, the resonator may exhibit zero, or very close to zero change in its operating parameters over the range of the controlled temperature. In particular, it has been found for a small change in temperature, 1 mK°, that the present invention can provide a resonant frequency stable to within 1 part in $10^{15}$.

It has been further recognized that the present invention is applicable more generally to resonators which employ normally conductive layers. Further, it has been recognized that it is not necessary to employ conductive layers at all to achieve the beneficial effects of the invention.

The present invention provides an electromagnetic resonator comprising: a dielectric substrate of predetermined material having a predetermined width and thickness, and having a predetermined length in the direction of propagation for achieving a desired resonance; first and second temperature compensating dielectric layers on two opposite faces of the substrate and extending along the length of the substrate, the dielectric layers being of a predetermined material and having a predetermined thickness; and the arrangement being such that the wave velocity of the resonator is dependent on the parameters of the substrate and first and second temperature compensating layers whereby the temperature dependence of the frequency of resonance of the resonator can be maintained within a predetermined range over a predetermined temperature range.

The temperature dependence of the temperature compensating layers can be of opposite sign to that of the substrate.

The first and second conductive layers can be formed on the outer surfaces of the respective first and second temperature compensating dielectric layers. The conductive layers can be a normal conductor such as copper or, as preferred, HTS superconducting layers such as YBCO. As will be shown below, it is desirable to select the parameters of the temperature compensating layers such that at a selected temperature, the first derivative with respect to temperature of the phase velocity of the electromagnetic wave propagating in the resonator is zero at the operating temperature of the resonator.

In accordance with a preferred form of the invention, an expression for the wave velocity is provided, the first and second temperature derivatives of this wave velocity with respect to temperature are made zero or at any rate to a non-significant value by appropriate choice of materials and layer thicknesses in accordance with the wave velocity expression. Thus, the resonant frequency of a superconducting planar resonator is dependent on the material properties and thicknesses of the superconductors, the dielectric substrate and the temperature compensating layers. As preferred, the first and second derivatives with respect to temperature of a wave velocity ratio (with respect to free space) are put to zero for various combinations of material properties. For YBCO thin films on rutile with sapphire temperature compensating layers a turning point can be realised at T=60° K. As the temperature in cryogenic systems can be controlled to better than 0.1° mK, then frequency standards with stabilities of parts in $10^{15}$ are attainable.

In a further aspect, the present invention provides a procedure for stabilizing the resonant frequency of an electromagnetic resonator with respect to temperature comprising providing a dielectric substrate of predetermined width and thickness, of predetermined length in the direction of propagation for achieving a desired resonance, and having a dielectric constant; providing first and second dielectric layers on two opposite faces of the substrate and extending along the length of the substrate, each layer having a thickness and a dielectric constant; providing first and second conducting layers on the outer surfaces of the first and second dielectric layers having a thickness and a penetration depth for electromagnetic fields; and selecting materials, thicknesses and dielectric constants of one or more of the aforesaid layers in relation to the thickness and dielectric constant of the substrate so as to achieve a desired stability in resonant frequency over a range of temperatures.

BRIEF DESCRIPTION OF THE DRAWINGS

A preferred embodiment of the invention will now be described with reference to the accompanying drawings wherein.

DESCRIPTION OF THE PREFERRED EMBODIMENT

The use of superconducting films in transmission lines has many advantages for signal processing applications such as low dispersion, low loss, and wide bandwidth. The penetration depth and low-frequency resistance of superconducting thin films are important parameters.

Passive microwave devices such as filters, resonators and delay lines require high-quality HTS thin films and substrate materials.

Attempts to grow HTS films directly onto high-quality substrate materials have encountered some serious problems, due to large mismatches of both lattice constants and thermal expansion coefficients of the HTS films and some substrate materials. Also, the interdiffusion between the HTS films and substrate materials has been found to severely degrade the superconducting properties—see References [1], [2], [3].

In this invention, a resonator with a temperature independent frequency is provided. The design depends on the material properties and thicknesses of the superconductors, the dielectric substrate, and temperature compensating dielectric layers between the substrate and the superconductors. The first and second derivatives of propagation phase velocity with respect to temperature are made equal to zero.

Figure 1:
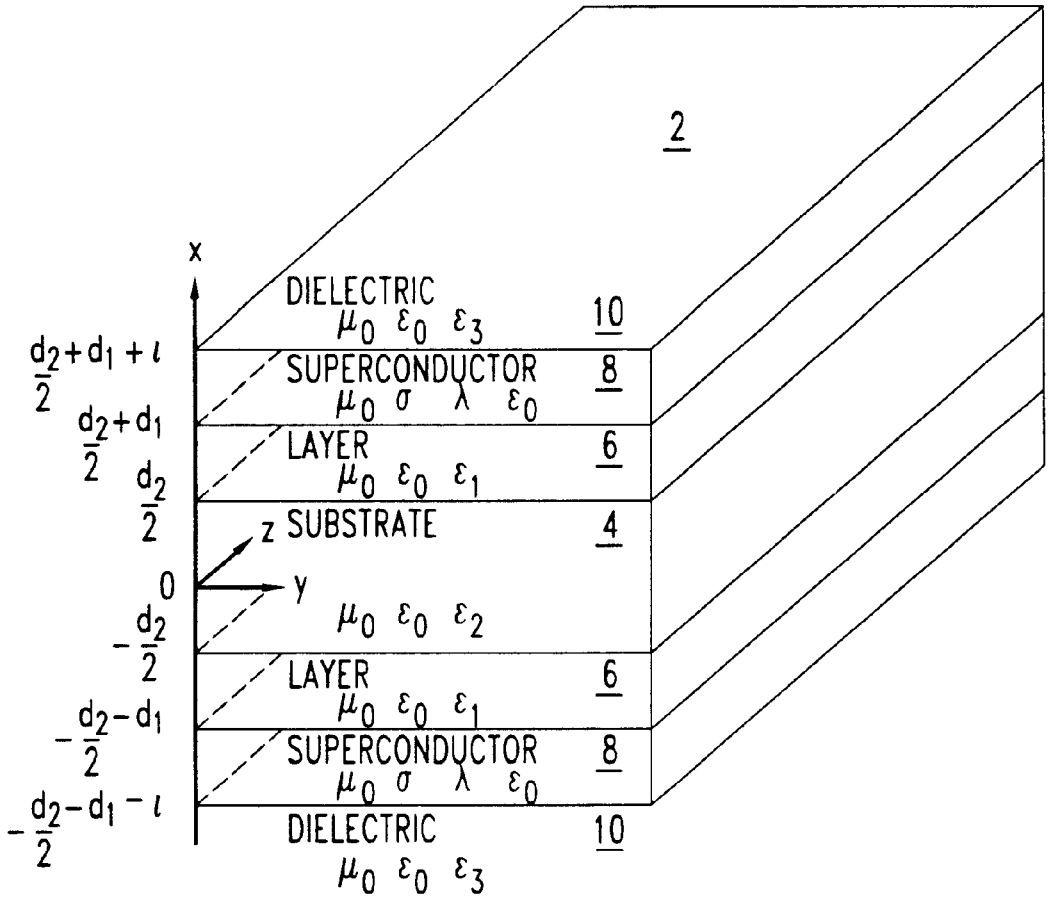
FIG. 1 is a schematic sectional view of a superconducting microwave resonator in accordance with the invention.

Referring to FIG. 1, there is shown a resonator 2 in accordance with the invention having a width Y a depth or thickness X and a predetermined length Z (for example $\lambda/2$) for resonance. The resonator has a substrate 4 of thickness $d_2$ with a dielectric constant $\epsilon_2$, and formed of rutile, which is a naturally occurring material consisting principally of $TiO_2$. First and second temperature compensating dielectric layers 6 are disposed above and below substrate 4, each of thickness $d_1$, having a dielectric constant $\epsilon_1$, and formed of sapphire. Disposed on the outer faces of layers 6 are superconductor layers (YBCO) 8 of thickness L, conductivity $\sigma$ and penetration depth $\lambda$. The superconductor layers 8 and layers 6 extend along the length Z of the resonator. Outside the superconductor layers 8 is disposed a dielectric 10 having a constant $\epsilon_3$, which may be, for example, free space.

Consider the propagation of an electromagnetic wave in the z-direction of the resonator shown in FIG. 1. It is assumed that the dielectric thicknesses ($d_1$ and $d_2$) and the penetration depth $\lambda$ of the high temperature superconductors are very small compared to the width Y of the resonator, which in turn is very small compared to the length Z of the resonator.

The dielectric region 10 outside layers 8 is considered to be very thick so that the fields in these regions can be assumed to exponentially decay away from the interfaces. From FIG. 1, and the above assumptions, it is clear that the edge effects can be neglected, and there is no Y-dependence of the fields and currents.

The two-fluid model is used for the superconductors, in which the total current is the sum of the supercurrent and the normal current. Classical skin effect and London theory are assumed for the normal current and the supercurrent, respectively.

Considering a TM wave:

$$\overline{H_y} = \frac{1}{\alpha\mu_0\omega}(\alpha^2 - \kappa^2)\overline{E_x}, \tag{1}$$

$$\overline{E_z} = -\frac{\iota}{\alpha}\frac{d\overline{E_x}}{dx}, \quad \frac{d^2\overline{E_x}}{dx^2} - \kappa^2\overline{E_x} = 0,$$

where, for the dielectrics:

$$\kappa^2 \triangleq K_r^2 = \alpha^2 - \omega^2\epsilon_r\mu_o, \; r=1,2,3, \tag{2}$$

while for the superconductors:

$$\kappa^2 \triangleq \kappa^2 = \frac{1}{\lambda^2} + \alpha^2 - \omega^2\varepsilon_a\mu_a + \iota\omega\mu_o\sigma, \tag{3}$$

where normal conductors are employed:

$$\kappa^2 \triangleq \kappa^2 = \alpha^2 - \omega^2\epsilon_a\mu_o + i\omega\mu_o\sigma. \tag{4}$$

Here, $\alpha$ is the propagation constant along the z direction (taking $e^{-i\alpha z}$), $\omega$ is the angular frequency (assuming $e^{i\omega t}$), $\epsilon_o$ and $\mu_o$ are the permittivity and the permeability of vacuum respectively, $\epsilon_r$ is the dielectric constant of the dielectrics, $\lambda$ and $\sigma$ are the penetration depth and the conductivity of the superconductors, respectively, $\kappa$ is the total propagation constant, $\triangleq$ means equals by definition and $\kappa_r$ is the propagation constant of layer numbered r. Equation (1) is a second-order differential equation which has two independent solutions of the form $e^{\kappa X}$ and $e^{-\kappa X}$, where $\kappa$ is taken to be the root of $\kappa^2$ with positive real part. In the positive x-direction of the dielectric, region 10, we take only the solution $e^{-K_3 x}$, and in the negative x-direction we take only the solution $e^{K_3 x}$, discarding $e^{K_3 x}$ for positive x-direction, and $e^{-K_3 x}$ for negative x-direction. In the superconductors, the temperature compensating dielectric layers 6, and in the substrate 4, both solutions are retained in order to satisfy the boundary conditions. In the normal or superconductors 8, and in dielectrics 4, 6, we need both solutions in order to satisfy the boundary conditions. With these solutions in the various media, we have twelve arbitrary constants for the amplitudes of the fields (one each in the dielectric region 10, two each in the superconductors 8, the temperature compensating dielectric layers 6 and the substrate 4). There are twelve boundary conditions that must be satisfied, namely the continuity of the tangential fields $\overline{E}_z$, and $\overline{H}_y$ at the six boundaries shown in FIG. 1. If we ignore any non-linearity in the system, the characteristics of the resonator are independent of the amplitude of the wave, and eleven of the constants can be determined in terms of the twelfth by using eleven of the twelve boundary conditions. The twelfth boundary condition gives an equation for the propagation constant $\alpha$, which must be satisfied in order for a solution to exist.

The condition is a transcendental equation for which an exact solution cannot be readily obtained. The approximations $K_1d_1<<1$ and $K_2d_2<<1$ are employed, where $K_1$ and $K_2$ are the respective propagation constants of layers 6 and substrate 4. Physically these approximations mean that higher order modes are ignored. With small $d_1$ and $d_2$, higher order modes will not be excited. With these assumptions, the transcendental equation yields:

$$\alpha^2 = \frac{\omega^2\mu_o\varepsilon_o\varepsilon_1\varepsilon_2}{(2d_1\varepsilon_2 + d_2\varepsilon_1)}\left[2\lambda\coth\left(\frac{l}{\lambda}\right) + 2d_1 + d_2\right] \tag{5}$$

In equation (5), the subscript $_0$ refers to the conductor layers 8, the subscript $_1$ refers to the dielectric layers 6, the subscript $_2$ refers to the substrate 4, and $\lambda$ refers to the penetration depth in superconductor layers 8. For normal conductor layers, such as copper, the penetration depth $\lambda$ should be replaced by the factor $$\sqrt{\frac{1}{\lambda^2} + i\omega\mu_0\sigma_r},$$

with $1/\lambda-0$. The wave velocity $V_r$ relative to that in a vacuum can be written as follows from equation (5):

$$V_r = \sqrt{\frac{(2d_1\varepsilon_2 + d_2\varepsilon_1)}{\varepsilon_1\varepsilon_2[2\lambda\coth(l/\lambda) + 2d_1 + d_2]}}. \tag{6}$$

According to equation (6), the wave is dispersionless even though there is a component of the electric field in the direction of propagation, i.e., the group velocity and phase velocity are equal and independent of frequency. The attenuation of the wave due to losses in each medium and the wave velocity $V_r$ have been obtained by replacing $\epsilon_1$, $\epsilon_2$ and $\lambda$ in to their complex forms.

Thus, it may be seen the superconducting transmission resonator with temperature compensating layers shown in FIG. 1 can be described by the penetration depth $\lambda$ of the superconductors, the dielectric constants of the dielectric layers and substrate, and the thicknesses $d_1$,$d_2$ and L of the dielectric layers, substrate and the superconductors. Where normal conductors are used the penetration depth $\lambda$ is replaced by the above expression.

The temperature dependence of the penetration depth $\lambda$ of a superconductor can be described by any one of several models outlined in Reference [4] Any of those models can be used in our analysis. However, we will concentrate on the following approximate result:

$$\lambda = \frac{\lambda_0}{\sqrt{1 - (T/T_c)^p}} \tag{7}$$

where $\lambda$ is penetration depth, $\lambda$0 is penetration depth at absolute zero temperature, T is temperature, Tc is critical temperature and P is a factor.

In equation (7), if the Gorter and Casimir model is assumed, then p=4. However, recently (Ref. 4), the spin-polaron theory of high-$T_c$ superconductivity has been explored, in which the charge carriers in a high-$T_c$ superconductor are considered as biholes obeying the Bose-Einstein statistics and localised within a unit cell of the crystal lattice. If the charge carrier system in a high-$T_c$ superconductor is considered as an ideal Bose-Einstein gas, then p=1.5. Using the Gorter and Casimir model, the variations of the first and second derivatives of $V_r$($dV_r/dT$ and $d^2V_r r/dT^2$) with respect to temperature for varying dielectric thicknesses of the temperature compensating layers are shown. The temperature dependence of the $\epsilon_r$ can be approximated—Reference [5]—as $\epsilon_1=9.2+2.5\times10^{-11}\ T^4$ (sapphire) and $\epsilon_2=113.446+0.043T-0.002T^2+7.724\times10^{-6}\ T^3-1.072\times10^{-8}T^4$ (rutile).

It may be observed that the temperature dependence of $\epsilon_1$ is of opposite sign to that of $\epsilon_2$.

To provide a resonator with a temperature independent frequency, or a transmission line with temperature independent propagation constant (and therefore phase shift) along the line, it is necessary to choose a configuration of substrate and temperature compensating layers which will cause the propagation velocity (or equivalently the transmission line wavelength) to be as independent of temperature variations as possible at the selected operating temperature.

Expanding expression (6) in a Taylor series about the operating temperature To leads to:

$$\delta V_r = \frac{dV_r}{dT}\delta T + \frac{1}{2}\frac{d^2V_r}{dT^2}\delta T^2 + \ldots$$

where the partial derivatives are evaluated at $T_0$, and where $\delta T=(T-T_0)$. If a certain temperature stability $\delta T$ can be achieved, then the minimum variation in $V_r(T)$ is attained if as many of the lower order partial derivatives as possible can be made zero, or close to zero. The first order approximation is to produce a turning point in $V_r(T)$ by ensuring $d\,V_r/dT=0$ at $T_0$. But, by judicious choice of geometry factors for a particular combination of dielectrics and superconductors, it is also possible to make $d^2V_r/dT^2$ zero, and even possibly higher order terms.

Figure 2:
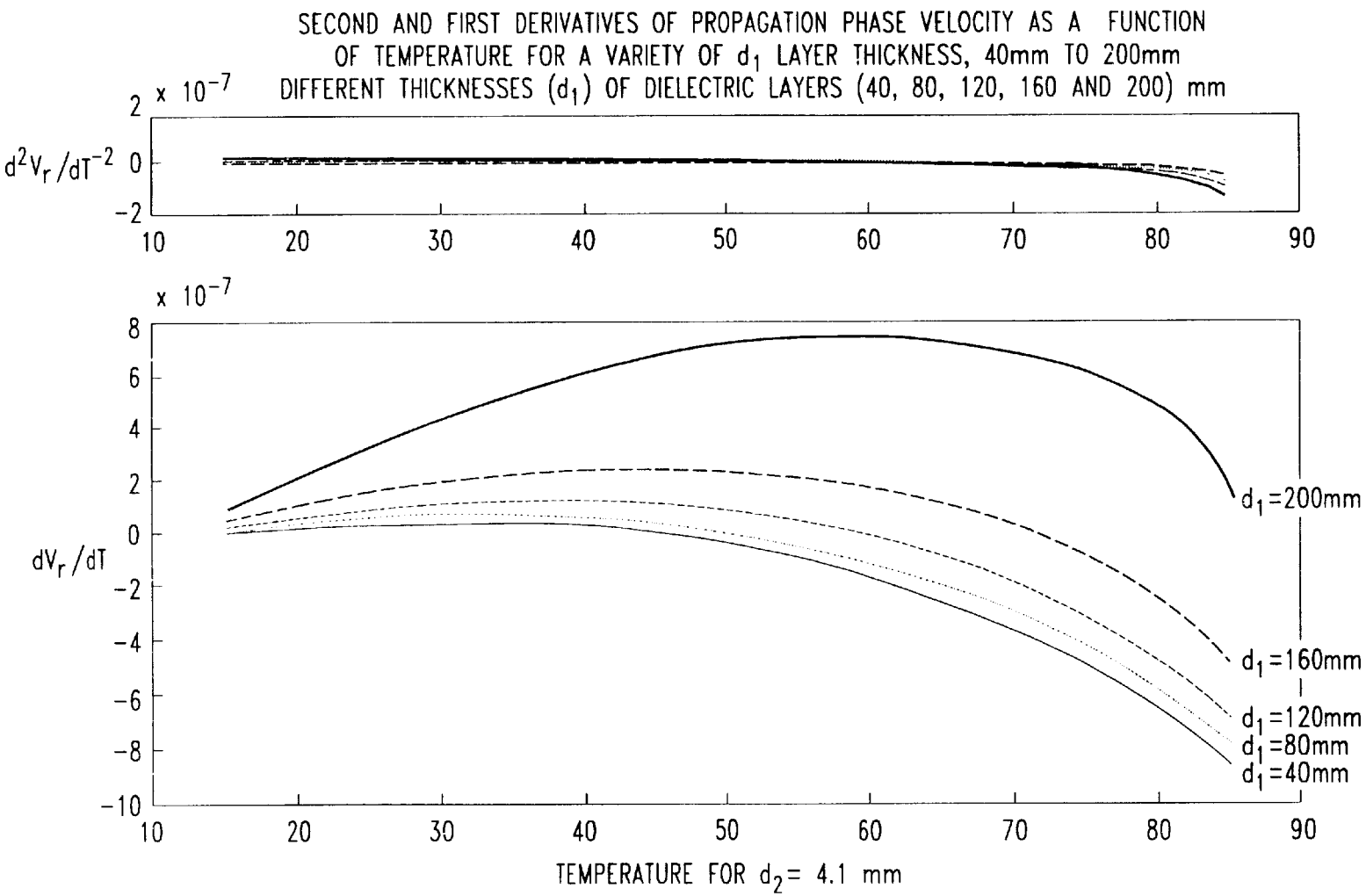
FIG. 2 is a graph showing second and first derivatives of propagation phase velocity as a function of temperature for a variety of temperature compensating layer thicknesses of the device of FIG. 1.

FIG. 2 shows the second and first derivatives of propagation phase velocity as a function of temperature for a variety of temperature compensating dielectric thicknesses between 40 mm to 200 mm, where sapphire is the temperature compensating layer and rutile is the substrate dielectric material. Turning points in $V_r(T)$ can be produced close to any chosen operating temperature in this way. Temperature compensating layer thicknesses of 40, 80, 120, 160 and 200 mm are shown with the 200 mm curve being the thickest line at the top of the curve family. The lower the curve shown in FIG. 2, the smaller is the thickness of temperature compensating layer. The graphs are shown for a substrate thickness of 4.1 mm with the material rutile (rutile is a naturally occurring mineral composed principally of $TiO_2$).

It will be seen for very low values of temperature the first derivative of temperature is approximately zero. As the temperature increases, for temperature compensating layers of a very small thickness, the value of the first derivative of temperature falls to a negative value, reflecting the fact that rutile is the main influence. For a thickness of 160 mm, the first derivative of phase velocity rises slowly with increasing temperature to a maximum at around 45° K and then falls off to a negative value. For a thickness of 200 mm, the first derivative of phase velocity increases markedly to a maximum at around 60° K. It then falls off very rapidly as the temperature approaches 80° K. Thus, it may be seen for the thicker layers the influence of the sapphire temperature compensating layers predominates for increasing temperature to give a positive value of phase velocity, until the influence of the rutile material begins to predominate, when a maximum value of the first derivative occurs, and then for increasing temperature the first derivative goes towards a negative value.

For the second derivative of propagation phase velocity, it may be seen that its value is zero or very close to zero over the range of temperatures, up to about 80° K. Thus, in this instance the second derivative will not be a significant factor in temperature variation. It is in any case a second order effect for changes in phase velocity as compared with the first derivative.

Figure 3:
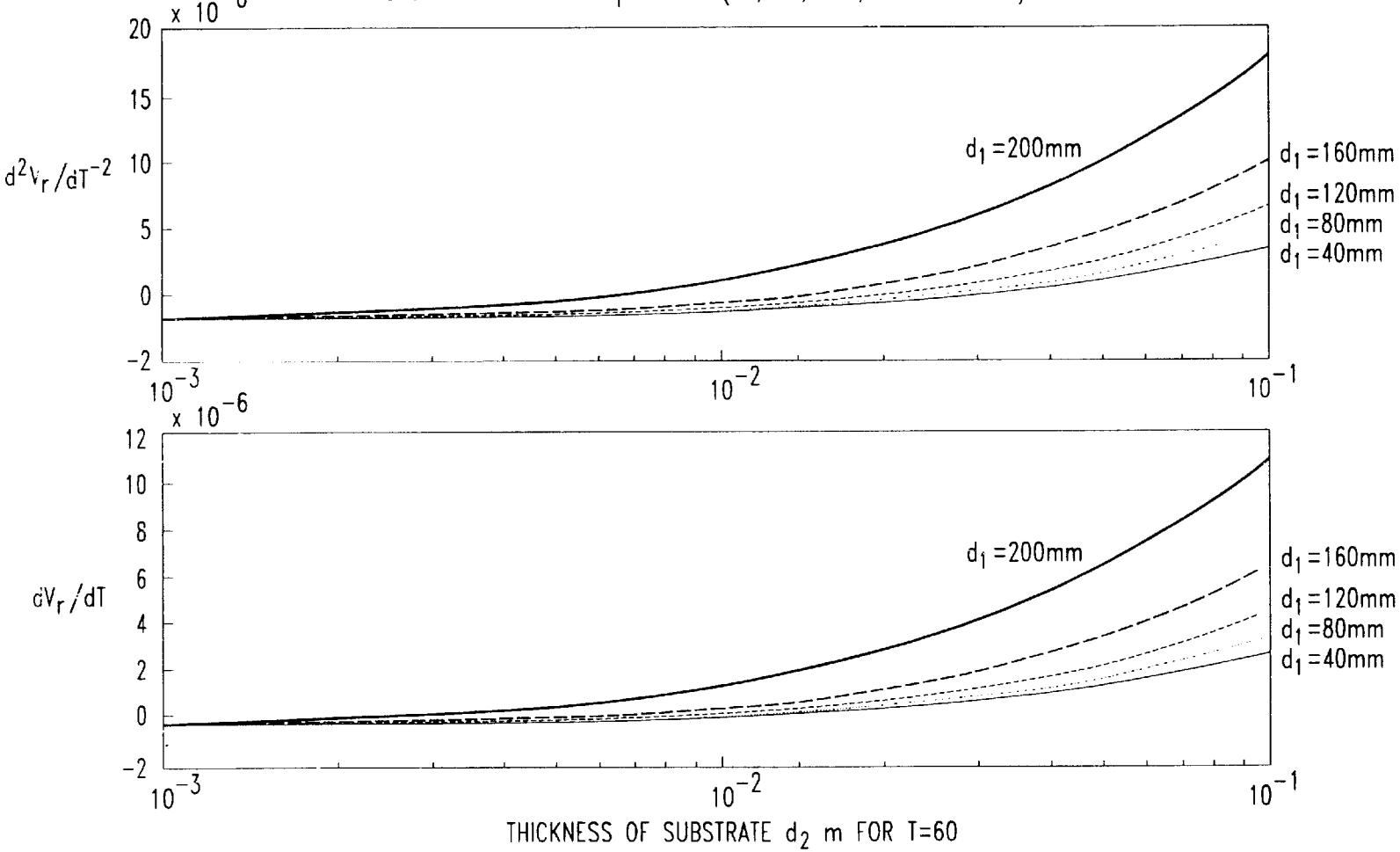
FIG. 3 is a graph of second and first derivatives of propagation phase velocity with respect to temperature as a function of the thickness of the substrate of the device of FIG. 1.

In FIG. 3 the first and second derivatives of propagation phase velocity with respect to T, at T=60 has been computed as a function of substrate thickness ($d_2$) for a variety of temperature compensating layer thicknesses ($d_1$), assuming sapphire as the temperature compensating layer and rutile as the main dielectric material. As with FIG. 2, various thicknesses of temperature compensating layers are shown, namely 200, 160, 120, 80 and 40 mm. These provide a family of curves with the thickest 200 mm layer being on top, with thinner layers producing a correspondingly lower curve. It may be seen that for both derivatives, their value remains close to zero until the thickness approaches 1 cm (values are shown in FIG. 3 in meters). The curves then diverge with the thickest temperature compensating layer of 200 mm increasing greatly as the substrate thickness approaches 10 cm.

Thus, it may be seen by appropriate selection of substrate thickness and temperature compensating layer thickness, together with appropriate choice of materials, turning points in the derivatives of phase velocity with respect to temperature can be produced at any desired temperature. In the above, the influence of the conductive layer has not been discussed, but this provides a further variable for adjusting the temperature response of the resonator, for example by changing the precise constituents of YBCO, or changing the thickness of the conductive layers.

Turning points in $V_r(T)$ can be produced at desired temperatures with any chosen substrate's thickness in this way. Clearly, the accuracy of the resonant frequency will depend on the range of temperatures to which the resonator is held. If, as with some cryogenic equipment, there is a range of operating temperatures of the order of 1° K, then the accuracy of the resonant frequency will be reduced as compared to that which is achievable when the temperature range is much more closely controlled.

In this invention, at least in the preferred embodiment, the first and second derivatives with respect to temperature of a wave velocity ratio (with respect to free space) for various combinations of material properties are put to zero. The dependence of resonant frequency on the dielectric constant and thicknesses of the substrate and temperature compensating layers is disclosed. An example of YBCO thin films on rutile with sapphire temperature compensating layers is provided. From this example, it may be concluded that if a turning point can be realised at T=60 K, and the temperature controlled to better than 0.1 mK, then frequency standards with stabilities of parts in $10^{15}$ are attainable. Thus, there is disclosed a new class of planar microwave components which are ultra stable in frequency with temperature.

What is claimed is:

1. An electromagnetic resonator (2) comprising a dielectric substrate (4) of a predetermined material having a width (Y) and thickness (X), and having a predetermined length (Z) in the direction of electromagnetic wave propagation for achieving a desired resonance;

first and second temperature compensating dielectric layers (6) on two opposite faces of the substrate and extending along the length of the substrate, the temperature compensating dielectric layers being of a predetermined material and having a predetermined thickness; and the arrangement being such that the wave velocity of the resonator is dependent on the dielectric constant and thickness of the substrate and first and second temperature compensating layers whereby the temperature dependence of the frequency of resonance of the resonator can be maintained within a predetermined range over a predetermined temperature range.

2. A resonator according to claim 1, including first and second conductive layers having a predetermined thickness and provided on the respective outer surfaces of the first and second temperature compensating dielectric layers.

3. A resonator according to claim 2, wherein the conductive layers are superconducting layers, and wherein the wave velocity Vr of the resonator is as follows:

$$V_r = \sqrt{\frac{(2d_1\varepsilon_2 + d_2\varepsilon_1)}{\varepsilon_1\varepsilon_2[2\lambda\coth(l/\lambda) + 2d_1 + d_2]}}$$

wherein $\lambda$ is the penetration depth within the superconducting layer and $\epsilon_1$ is the value of dielectric constant for the dielectric layers, $\epsilon_2$ is the value of dielectric constant for the substrate, $d_1$ is the thickness of each of the two dielectric layers and $d_2$ is the thickness of the substrate.

4. A resonator according to claim 2, wherein the conductive layers are of a conductive material, and wherein the wave velocity $V_r$ of the resonator is as follows:

$$V_r = \sqrt{\frac{(2d_1\varepsilon_2 + d_2\varepsilon_1)}{\varepsilon_1\varepsilon_2[2\beta\coth(l/\beta) + 2d_1 + d_2]}}$$

wherein $\epsilon_1$ is the value of dielectric constant for the dielectric layers, $\epsilon_2$ is the value of dielectric constant for the substrate, $d_1$ is the thickness of each of the two dielectric layers and $d_2$ is the thickness of the substrate, and wherein $\beta$ is given by the expression $$\sqrt{\frac{1}{\lambda^2} + i\omega\mu_0\sigma_r}$$

where l is the thickness of each conductive layer, $\omega$ is the angular frequency, $\mu_0$ is the permeability of vacuum and $\sigma_r$ is conductivity.

5. A resonator according to claim 1, wherein the first derivative with respect to temperature of the wave velocity is chosen to be substantially zero over a predetermined range of operating temperatures.

6. A resonator according to claim 1, wherein the second derivative with respect to temperature of the wave velocity is chosen to be substantially zero over a predetermined operating temperature range.

7. A resonator according to claim 1, wherein a predetermined operating temperature range is of the order of 1 $mK^0$.

8. A resonator according to claim 1, wherein the temperature dependence of the wave velocity in the predetermined material of the dielectric substrate is of opposite sign to that of the temperature compensating layers' dielectric material at a predetermined operating temperature.

9. A resonator according to claim 1, wherein the substrate is rutile, comprising $TiO_2$.

10. A resonator according to claim 1, wherein the temperature compensating layers comprise sapphire.

11. An electromagnetic resonator comprising a dielectric substrate of predetermined width (Y) and thickness (X), and having a predetermined length (Z) in the direction of electromagnetic wave propagation for achieving a desired resonance;

first and second dielectric layers on two opposite faces of the substrate and extending along the length of the substrate, the dielectric layers having a predetermined thickness;

first and second superconducting layers having a predetermined thickness and provided on the outer surfaces of the first and second dielectric layers; and the arrangement being such that the wave velocity $V_r$ of electromagnetic waves propagating along the length of the substrate is given as follows:

$$V_r = \sqrt{\frac{(2d_1\varepsilon_2 + d_2\varepsilon_1)}{\varepsilon_1\varepsilon_2[2\lambda\coth(l/\lambda) + 2d_1 + d_2]}}$$

wherein $\lambda$ is the penetration depth within the superconducting layer and $\epsilon_1$ is the value of dielectric constant for the dielectric layers, $\epsilon_2$ is the value of dielectric constant for the substrate, $d_1$ is the thickness of each of the two dielectric layers and $d_2$ is the thickness of the substrate, whereby the resonant frequency of the resonator may be stabilized over a given temperature range by making the derivative of $V_r$ with respect to temperature zero or close to zero within the temperature range, by appropriate choice of the dielectric constant and thickness parameters of $V_r$.

12. A method for stabilizing the resonant frequency of an electromagnetic resonator with respect to temperature comprising;

providing a dielectric substrate of predetermined width and thickness, of predetermined length in the direction of electromagnetic wave propagation for achieving a desired resonance, and having a dielectric constant;

providing first and second dielectric layers on two opposite faces of the substrate and extending along the length of the substrate, each layer having thickness and a dielectric constant;

providing first and second conducting layers on the respective outer surfaces of the first and second dielectric layers having a thickness and a penetration depth for electromagnetic fields; and selecting materials, thicknesses and dielectric constants of one or more of the aforesaid layers in relation to the thickness and dielectric constant of the substrate so as to achieve a desired stability in resonant frequency over a desired range of temperature.

* * * * *